United States Patent [19]

Vandergriff

[11] Patent Number: 4,914,786

[45] Date of Patent: Apr. 10, 1990

[54] FEEDER FOR COTTON GIN

[75] Inventor: Arvel L. Vandergriff, Visalia, Calif.

[73] Assignee: Consolidated HGM Corporation, Lubbock, Tex.

[21] Appl. No.: 320,478

[22] Filed: Mar. 8, 1989

[51] Int. Cl.[4] ..... D01B 1/04

[52] U.S. Cl. ..... 19/64.5

[58] Field of Search ..... 19/48, 50, 51, 52, 53, 19/54, 55 R, 64.5, 105, 204

[56] References Cited

U.S. PATENT DOCUMENTS

| | | | |
|---|---|---|---|
| 3,251,094 | 5/1966 | Vandergriff | 19/53 |
| 3,769,658 | 11/1973 | Brooks | 19/64.5 |
| 4,094,043 | 6/1978 | Vandergriff | 19/53 |
| 4,153,976 | 5/1979 | Vandergriff | 19/53 |
| 4,458,381 | 7/1984 | Van Doorn et al. | 19/64.5 |

*Primary Examiner*—Henry S. Jaudon
*Assistant Examiner*—Michael A. Neas
*Attorney, Agent, or Firm*—Wendell Coffee

[57] ABSTRACT

In a feeder for a roller gin, locks of seed cotton are pressed against a flexible knobby roller having pockets. Each pocket holds only one seed, thus spacing the seed one from another. A doffing roller adjacent the knobby roller travels at least twice as fast as the knobby roller. This lint and the seed of the cotton are pulled over at transfer edge between the knobby and doffing roller, thereby breaking the locks of seed cotton into individual seed locks which are spaced apart. Thus, the cotton is combed and smoothed and formed into a batt of a single layer of seed locks.

17 Claims, 2 Drawing Sheets

FEEDER FOR COTTON GIN

RIGHTS TO INVENTIONS UNDER FEDERAL RESEARCH

There was no federally sponsored research and development concerning this invention.

BACKGROUND OF THE INVENTION

1. Field of the Invention

This invention relates to roller cotton gins. Builders of roller cotton gins have ordinary skill in this art.

2. Description of the Related Art

As clearly set out in my prior three patents, U.S. Pat. No. 3,251,094; U.S. Pat. No. 4,094,043; and U.S. Pat. No. 4,153,976, cotton gins are of two categories: saw gins and roller gins. Normally, fuzzy seed, or upland, or short staple cotton is gained by a saw gin. Long staple cotton sometimes called black seed, sea island, or Egyptian cotton, is ginned with roller gins. Normally, the cotton fibers are attached to the seed of sea island cotton much more loosely than are the seed of upland cotton.

Cotton is produced in bolls.

Each boll will have from about three to seven locks of cotton. These locks or segments are naturally produced with a fibrous membrane between them. When the cotton is removed from the burr or boll, it will be removed by locks. A lock of seed cotton will have about six to nine single seed per lock. Each of the seed within a lock of cotton will be with a single seed lock, which is one seed with the lint attached to it. I.e., each strand or filament or fiber of lint will be attached to only one seed. Therefore, it might be seen that a lock of seed cotton is made up of single seed locks, each seed lock being the seed with the lint attached on it.

Under present practice, the gin roller or the main roller of a roller gin is fed by a feeder which cleans the seed cotton. By the term seed cotton, it is meant the cotton with both lint and seed in it. The seed cotton is not only cleaned, but it is divided into individual locks. These locks are then dropped from a pan, tray, apron, or plate onto the gin roller. Then, the seed and lint are separated thereon, as is known to the art, particularly referring to my prior three patents. A typical gin roller will be 15" in diameter and 40" in length and be rotated at 120 revolutions per minute. Normally, the ginning capacity of such a roller will be less than two bales to the hour. At two bales per hour, about 3,000 lbs. of seed cotton would be fed to the gin roller in an hour, about 1,000 pounds of lint will be produced from the gin roller, and about 2,000 pounds of seed.

On most sea island cotton, there about 2,000 seed per pound of seed cotton. Stated otherwise, there are about 3,000,000 seeds per bale, i.e., at two bales per hour, the gin is fed by placing locks of seed cotton with about about 6,000,000 seed per hour upon the gin roller. Calculation will show that the seed will be applied to the gin roller at about one seed for every two square inches of the gin roller, or about 72 seed per square foot.

The problem exists that the seed are not applied evenly to the surface but are applied by locks of cotton, each lock carrying several seed.

It is recognized in the art that in operation, if ever the cotton lumps or balls up at the ginning point, it causes a problem. This is outlined in the prior art.

Also, it is recognized that if the cotton could be fed evenly to the gin rollers that the ginning blade on the roller would be able to accommodate seed cotton at a rate resulting in more than one seed for every two square inches of gin roller.

BROOKS, U.S. Pat. Number 3,769,658 recognized the advantage of feeding cotton to a roller at a faster rate than what had been done before. The patent discloses feeding the cotton into a series of rollers which condensed the cotton. I.e., they are first fed at a greater rate of linear travel than the rate they are fed to the gin roller.

SUMMARY OF THE INVENTION

1. Progressive Contribution to the Art

I have invented a process and machinery to apply a greater number of seed to the gin roller. It is obvious that the gin roller will handle more than about one seed per every two square inches, if the seed are evenly distributed.

If the longitudinal spacing or the spacing measured in a circumferential direction along the roller were no greater than one seed for one circumferential inch along the gin roller, that this could be handled quite well. Probably, the seed could be spaced closer than one inch apart in the direction of the blade.

Basically, according to my invention, the cotton is first arranged so that one seed is not on top of another seed. The cotton is fed so that there is about 100 seed per square foot of the gin roller. This will be about 4,500 lbs. of seed cotton fed from the feeder per hour. I.e., there is sufficient seed cotton from the feeder to gin about three bales per hour. After the seed are arranged so that the seed are not superimposed, the entire batt of seed cotton is stretched by causing the batt to move faster at the point it is fed to the gin roller than at the point the feeding process beginning. A portion of each lock of cotton is held while other portions are moved faster, thereby stretching the cotton and applying it to the ginning roller. If the locks first begin their travel at one-half the circumferential or peripheral or gin speed of the gin roller, the seed will be moved so that they are twice as far apart when fed to the roller as they are in the original arrangement.

My present invention is a feeding attachment which separates the mass of seed and lint in a lock of seed cotton into single seed locks and feeds them to the ginning section in a manner closely approaching this ideal pattern of one seed lock per square inch of ginning roller, which is about 150 seed per square foot.

In order to accomplish this, the scattered pattern and multiple layers delivered by current feeding units must be interrupted in its flow down the feeder apron, and to form a solid layer of seed locks on the apron. This layer of seed locks then, by the action of a feed roller, is compressed between the surface of the apron and the feed roller. The down stream end of the apron acts as a feed plate and is held tightly against the roller by spring tension.

The surface of the feed roller and its action on the mass of seed locks is a key to obtaining the single seed lock distribution. The roller is covered by a sheet of flexible material having a knobby surface, the knobs being pointed and spaced so that only a single seed with its attached fibers will fit between them.

The is as mass pressed between this surface and the feed plate, the seed are pressed into this pocket, while any additional seed entangled in the mass are pushed into the adjacent pocket. It is important to coordinate the rate of flow and the speed of the roller so that as nearly as possible, there is a single layer of seed locks being carried by the roller over the feed plate. s As the mass if fed over the transfer edge of the feed plate, a second roller, preferably consisting of a series of serrated metal disks mounted on a tube or shaft, closely spaced and mounted on the shaft on an angle so they wobble as they turn. Obviously many other forms of toothed cylinders could be used.

The points of the serrations pass close to the face of the feed plates, pulling the seed locks from the pinch point, and as the seed are pulled away, the fibers stretch to the point of separating the mass into single seed locks. Many seed will be completely ginned at this point.

The seed cotton is fed directly from the second or doffing roller to the pinch point formed by the surface of the ginning roller and the rotatable bar.

It is obvious that such a destruction of the locks of cotton into single seed locks will result in at least a 50% increase in the capacity over scattered pattern delivered by the current arrangement.

The seed may be acceptably spaced close together in the direction of the ginning blade, but they should be spaced a greater distance apart along the direction of travel, for the reasons explained in my prior three patents, of the way the seed are swept along the ginning blade at one-half the staple length.

2. Objects of this Invention

An object of this invention is to feed a gin roller or a roller type gin with a sheet or batt of cotton wherein the seed are spaced apart.

Another object is to feed seed cotton to a roller gin in a single layer sheet of seed locks.

Further objects are to achieve the above with devices that are sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is rapid, versatile, ecologically compatible, energy conserving, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

Figure 1:
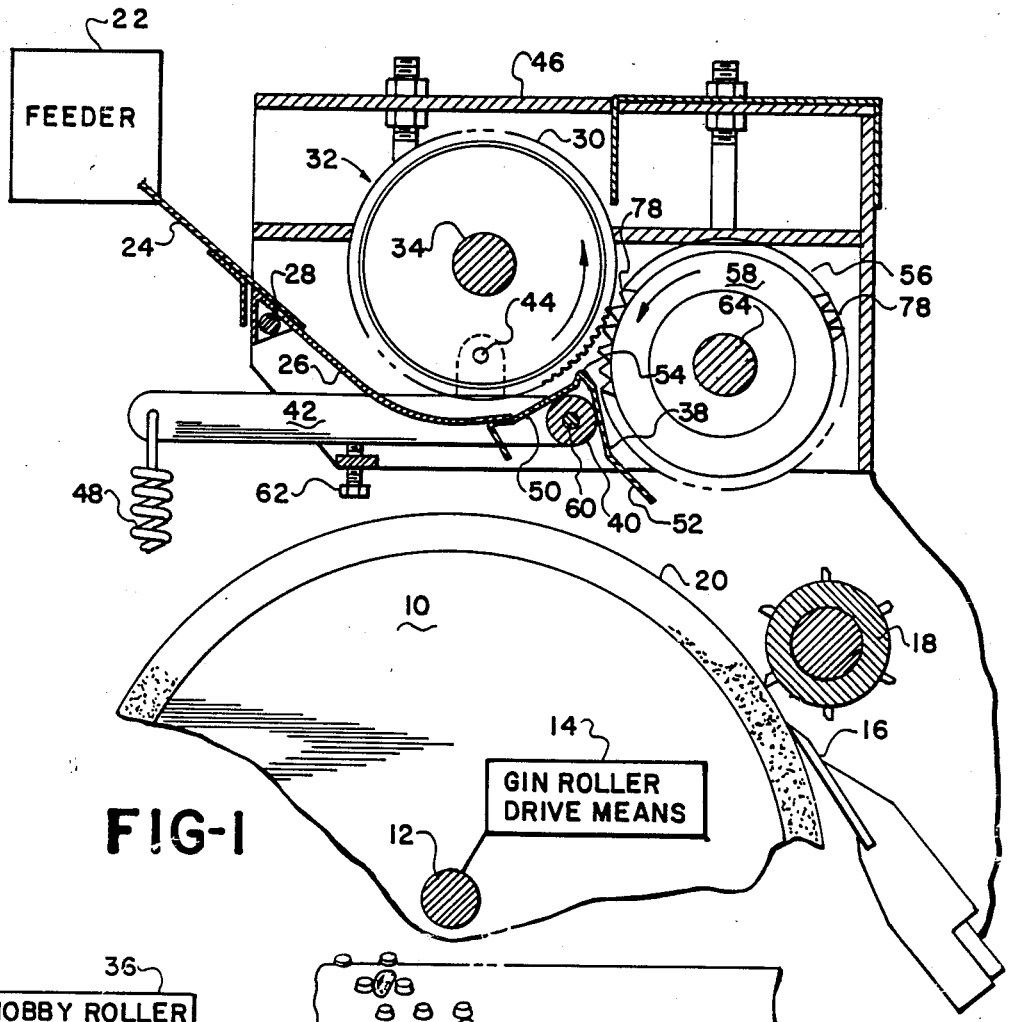
FIG. 1 is a cross sectional view, somewhat schematic of an embodiment of this invention.
Figure 2:
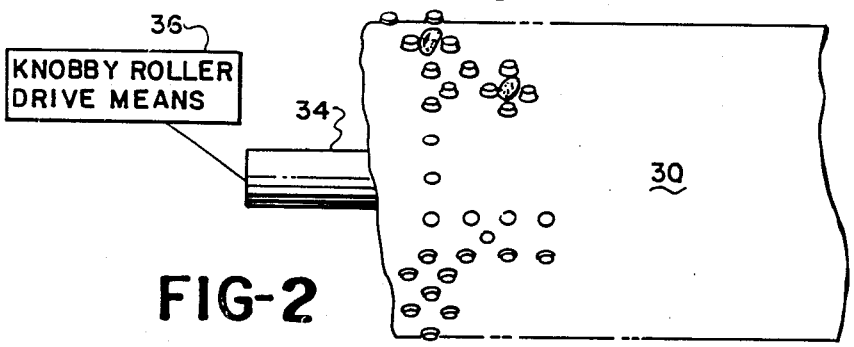
FIGS. 2 and 2' is a top plan view of a portion of the knobby roller and the doffing roller.
Figure 2:
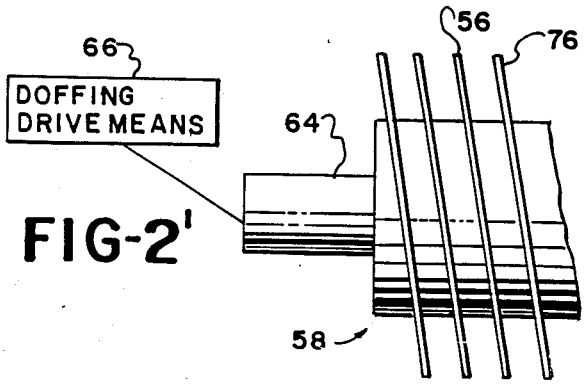
Figure 3:
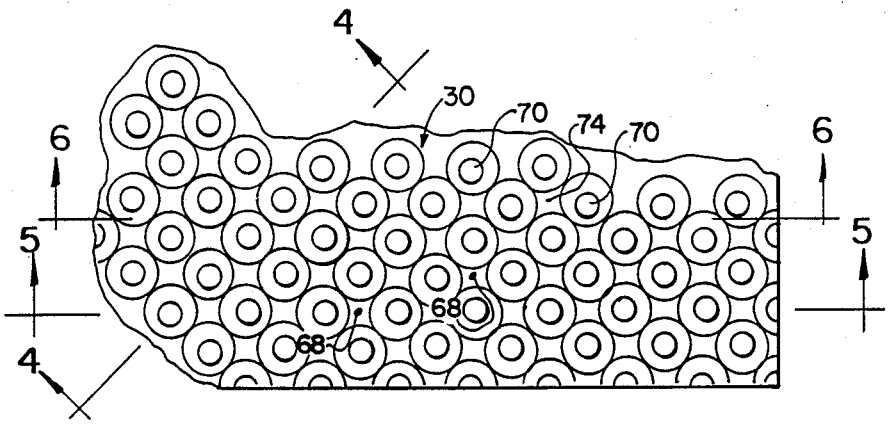
FIG. 3 is a developed plan view of a portion of the surface of the knobby roller.
Figure 4:
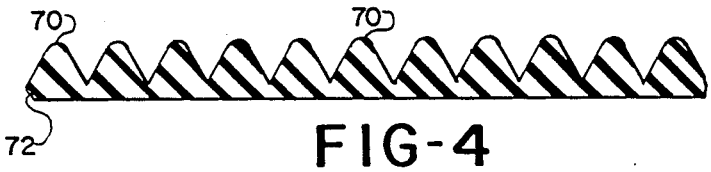
FIG. 4 is a sectional view taken substantially on line 4—4 of FIG. 3 of the surface of the knobby roller.
Figure 5:
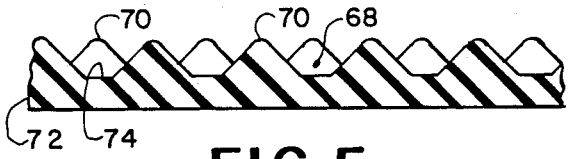
FIG. 5 is a sectional view taken substantially on line 5—5 of FIG. 3 of a portion of the surface and the knobby roller.
Figure 6:
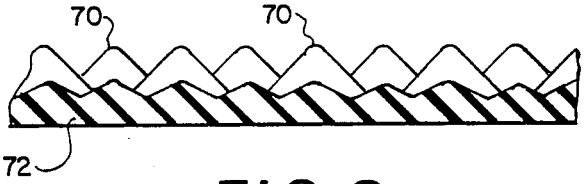
FIG. 6 is a sectional view taken substantially on line 6—6 of FIG. 3 showing a portion of the knobby roller.
Figure 7:
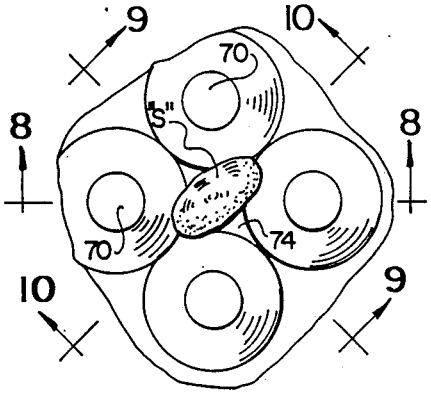
FIG. 7 is an enlarged plan view of the surface of the knobby roller, being an enlarged view of what is shown in Figure 3 with the addition of a cotton seed in a pocket formed by four of the knobs of the knobby roller.

As an aid to correlating the terms of the claims to the exemplary drawing, the following catalog of elements and steps is provided:

10 gin roller
12 shaft
14 roller drive means
16 stationary blade
18 rotating knife
20 peripheral surface
22 feeder
24 apron
26 pivot apron
28 hinge pin
30 knobby surface or first carrier
32 knobby or spacing roller
34 shaft
36 knobby drive means
38 transfer plate
40 bar
42 arm
44 pivot
46 housing
48 spring
50 entry lip
52 feed plate
54 transfer edge
56 doffing surface or final carrier
58 doffing or feeding roller
60 screw
62 stop
64 doffing shaft
66 doffing drive means
68 pockets
70 knob
72 base
74 flat
76 plates
78 teeth
"S" seed

DESCRIPTION OF THE PREFERRED EMBODIMENT

Referring to the drawings, there may be seen represented ginning or gin roller 10 which is mounted for rotation about shaft 12. Schematically represented is roller drive means 14 connected to the roller for rotating the roller so its peripheral surface 20 has a peripheral or gin speed of about 5,500 to 5,750 inches per minute.

Doctor or stationary ginning blade 16 is adjacent to the gin roller as is well known. Rotating knife 18 is mounted adjacent to the peripheral surface 20 close to the ginning point between the ginning knife 16 and gin roller 10 as is explained in my prior patents identified above.

Feeder 22 feeds individual locks of cotton down apron 24. It will be understood that the locks of seed cotton will be as is grown naturally and will include 6–9 seed along with the lint.

Those having skill in the art will understand that the equipment described to this point is old and well known to the art.

Pivot apron 26 is pivoted by hinge pin 28 to attachment housing 46 connected to the feeder 22 at the bottom of apron 24. The lower portion of the pivot arm is curved to mate knobby surface 30 of knobby or spacing roller 32, which is mounted upon its shaft 34. Knobby drive means 36 is connected to the shaft 34 to rotate it so that the knobby surface 30 has a speed which is less than the peripheral or gin speed of the peripheral surface 20. As stated above, the peripheral or gin speed is about 5,600 inches per minute. The speed of the knobby surface or first carrier would be less than about 2,800 inches per minute, which is about half the gin speed. The preferred speed of the knobby surface is about 700 to 1,860 inches per minute, which is, about $\frac{1}{8}$ to $\frac{1}{3}$ of the gin speed.

Many factors will be involved in the actual speed of the knobby surface. The preferred embodiment of the invention employs a variable speed knobby roller drive means 36 so that the speed can be varied within the preferred limits of 700 inches per minute to 1,860 inches per minute. The actual speed that it will be run will depend upon such factors as the variety of cotton being ginned, the maturity of the cotton, the cultural practices under which it were grown (temperature, irrigation, fertility), as well as the moisture content of the lint at the time it is being ginned. The present indications are that generally the speed of the knobby surface is preferred to be about 900 to 1,000 inches per minute.

Transfer plate 38 is mounted upon bar 40. The bar 40 is connected to arm 42 which is pivoted by pivot 44 to the frame of the attachment housing 46. The bar 40 is on one end of the arm 42, and spring 48 is on the opposite end. The transfer plate has an entry lip 50 which is curved like the bottom of the pivoted apron to fit the contour of the knobby surface 30. The sheet or batt of cotton will follow along the knobby surface, and the batt will have the same speed as the knobby surface, which is called the spacing speed.

The transfer plate 38 also has an exit plate or feeding plate 52 to direct the cotton onto the gin roller 10. The transfer plate has a transfer edge 54 which is between the knobby surface 30 of the knobby roller and the doffing surface 56 of the doffing roller 58. The bar 40, and thus, the transfer plate can be angularly or rotatably adjusted to the arm 42 by screw 60 threaded into an axial bore. The screw 60 clamps the bar 40 at each end to the arm 42, there being one on each side of the feeder 22.

The spring 48 biases the transfer edge 54 to the pinch between the knobby roller 32 and the doffing roller 58. Stop 62 limits the movement of the arm 42 to prevent the transfer edge and the entry lip 50 from actual contact with the knobby roller. It will be noted that the pivot 44 has the same elevation approximately as the transfer edge 54; and therefore, rotation about the pivot 44 will not cause the transfer edge 54 or the feed plate 52 to come closer to the doffing surface 56 of the doffing roller 58.

The doffing roller 58 is attached to doffing shaft 64. Doffing drive means 66 is mechanically connected to the doffing shaft and forms a means for driving it so that the doffing surface 56 travels at a speed of at least 80% of the gin speed of the gin surface 20. The preferred speed is about 6,000 to 6,400 inches per minute, which is slightly faster than the gin surface speed.

Analysis will show that the knobby roller, the doffing roller, and the transfer plate all form parts of a transfer means by which the locks of seed cotton on the knobby roller (the surface of which might be considered a first carrier) is transferred onto the surface of the doffing roller, which might be considered second carrier. The locks of cotton will be held by the spring tension onto the surface of the knobby roller. The doffing roller will catch the particles of lint, seed, and the like and pull them over the transfer edge 54. This movement over the transfer edge will not only doff the cotton as it comes over, but it will also tend to break up the locks of seed cotton into the individual seed locks. During this breaking up process, it will also stretch the cotton so that it will separate and the seed locks further apart. In addition to this, it will comb the lint.

Preferably, the knobby roller 32 has a diameter of about 5". Doffing roller 44 is mounted upon its shaft 46 so that doffing surface 48 is close to the knobby surface 30. It is preferred that the doffing surface 56 be as close as manufacturing tolerances will allow without having actual contact with the knobby surface 30. The preferred diameter of the doffing roller is also about 5".

The spring 48 biases the entry lip 50 against the knobby surface 32 so that the individual seed within the lock of seed cotton will be placed in the individual pockets 68 of the pocketed surface As outlined above, it is an important part of this invention that there be only one seed per pocket 68.

FIGS. 3 through 9 show, in some detail, the knobby surface 30. It is made of a flexible material such as rubber or a synthetic elastomer. The surface has a series of projecting knobs 70 from a base 72. The knobs are spaced so that there will be flat spaces 74 adjacent to the base. These flat spaces will form the pockets 68 which will be above the flat space 74 and between the knobs 70. The knobs might be more accurately described as truncated cones or cones with a rounded bullet shaped nose. It is contemplated that there would be between 12 to 20 pockets per square inch.

Figure 8:
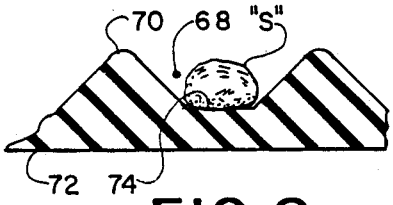
FIG. 8 is a sectional view taken substantially on line 8—8 of FIG. 7 showing the seed in the pocket.
Figure 10:
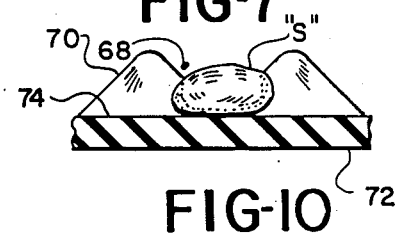
FIG. 10 is a sectional view taken substantially on line 10—10 of Figure 7 showing the seed in a pocket.
Figure 9:
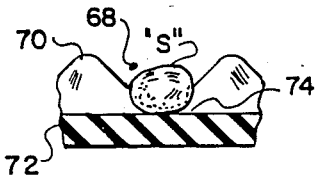
FIG. 9 is a sectional view taken substantially on line 9—9 of FIG. 7 showing the seed in a pocket.

Regardless of the exact configuration of the knobby surface, the results achieved by it is to provide a series of pockets 68 so that the seed "S" may be separated so that one seed, and one seed only will fit in each pocket; and therefore, the seed will be separated one from another, forming a sheet of cotton which has a single layer of the seed locks therein. FIGS. 8, 9, and 10 are an effort to illustrate this requirement. Many of the pockets 68 may be empty but none should have more than a single seed "S".

The individual locks of seed cotton will be moved by the knobby surface 30 at a speed, herein called a first speed or spacing speed, of less than half of the gin speed of the peripheral surface 20. When the cotton is doffed by the doffing surface 56, its speed will be increased to what is called a feeding speed, which will be at least 80% of the peripheral speed. Each lock of seed cotton will be held (as between the knobby surface and the entry lip and also across the transfer lip) while this increase of speed is taking place. Thus, each individual lock of cotton is stretched and combed in the process. Also, the knobby surface 30 carries the locks of cotton; and therefore, could be described herein as a first carrier. Also, the doffing surface 56 could be considered to be a feeding carrier. Also, if the doffing surface 56 has a speed which is less than the peripheral speed of the peripheral surface 20, that a certain amount of stretching will occur between the feeding of the cotton batt from the doffing surface to the peripheral surface.

The knobby surface 30 is formed by a series of knobs 60 formed upon the yieldable flexible surface. These knobs are pyramids, with one side of the base of each pyramid contacting the base of another pyramid, and the space between the pyramids forming the pockets 68 as described.

The doffing surface 56 is formed of a series of plates 76 mounted upon the shaft 64, each of the plates having a serrated or notched surface 56. The plates are parallel to each other and angled to the shaft. The serrations or teeth 78 are designed to break up the locks of seed cotton into individual seed locks and smooth or comb the lint of the seed locks.

Referring again to the drawings, it may be seen that the knobby roller, doffing roller, and transfer plate can all be made as a unit on housing 46 and connected as by bolting as an attachment to existing feeders. Those having ordinary skill in the art will understand how this attachment, together with the drive means, is made.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A process of feeding seed cotton in the form of locks with seed therein to a roller gin having:

a. a gin roller with a peripheral surface, b. drive means connected to the gin roller for rotating the gin roller so that the peripheral surface has a gin speed;

c. wherein the improved method comprises:

d. moving the locks of seed cotton at a spacing speed of less than about half the gin speed, e. increasing the speed of the seed cotton to a feeding speed of at least about 80% of the gin speed, f. holding the locks while increasing the speed so that the locks are stretched, thereby g. increasing the spacing between the seed, and h. feeding the seed cotton moving at the feeding speed onto the gin roller.

2. The invention as defined in claim 1, further comprising:

i. feeding the seed cotton onto the gin roller at a rate having an average density of at least about 100 seed per square foot.

3. The invention as defined in claim 1, further comprising:

j. said spacing speed being about $\frac{1}{3}$ to $\frac{1}{8}$ of the gin speed.

4. The invention as defined in claims 1, further comprising:

j. said feeding speed being at least the gin speed.

5. The invention as defined in claim 1, further comprising:

i. spacing the seed apart from one another while the seed are traveling at the spacing speed.

6. The invention as defined in claim 5, further comprising:

j. feeding the seed cotton onto the gin roller at a rate having an average density of at least about 100 seed per square foot.

7. The invention as defined in claim 6, further comprising:

k. said spacing speed being about $\frac{1}{3}$ to $\frac{1}{8}$ of the gin speed, and l. said spacing speed being adjustable.

8. The invention as defined in claim 7, further comprising:

m. said feeding speed being at least the gin speed, and n. combing the cotton as it is being increased in speed from the spacing speed to the feeding speed.

9. A feeder for feeding seed cotton in the form of locks having seed therein to a roller gin having:

a. a gin roller with a peripheral surface, b. roller drive means connected to the gin roller for rotating the gin roller so that the peripheral surface has a gin speed;

c. wherein the improved structure comprises:

d. a first carrier carrying seed cotton at a speed of less than about half the gin speed, e. transfer means on the feeder for transferring and stretching locks of the seed cotton from the first carrier to a f. final carrier carrying the seed cotton at a speed of at least about 80% of the gin speed, and g. said final carrier adjacent to the gin roller so that the seed cotton is discharged from the final carrier onto the gin roller.

10. The invention as defined in claim 9, further comprising:

h. a surface on the first carrier, i. pockets in the surface of the first carrier, j. said pockets so arranged in size as to be adapted to receive only one seed in each pocket, k. thereby forming a means for spacing the seed apart on the first carrier.

11. A feeder for feeding seed cotton in the form of locks with seed therein to a roller gin having:

a. a gin roller with a peripheral surface, b. roller drive means connected to the gin roller for rotating the gin roller so that the peripheral surface has a gin speed;

c. wherein the improved structure comprises:

d. a knobby roller having e. a knobby surface having pockets therein, f. knobby drive means connected to the knobby roller for rotating it so that the knobby surface has a speed of less than about half the gin speed, g. apron means on the feeder for carrying the seed cotton to h. a feed pan below the knobby surface of the knobby roller, i. a spring connected to the feed pan biasing the feed pan against the knobby surface so that j. each seed of the seed cotton is pressed into one of the individual pockets upon the knobby surface, k. a doffing roller, l. said doffing roller having a doffing surface adjacent to said knobby surface, m. doffing drive means for driving said doffing roller so the doffing surface has a speed of at least 80% of the gin speed, and n. a guide plate on the feed pan for guiding seed cotton from the doffing roller onto said peripheral surface.

12. The invention as defined in claim 11, further comprising:

o. knobs on said knobby surface projecting in a pattern so that the projecting knobs form pockets between the knobs, p. each of said pockets of such a size to hold only one seed of cotton.

13. The invention as defined in claim 12 further comprising:

q. said knobby surface being flexible.

14. The invention as defined in claim 13, further comprising:

r. a transfer edge on the feed pan projecting between the knobby roller and the doffing roller so that the doffing roller pulls the cotton across the transfer edge while the pan is biased against cotton between the feed pan and knobby surface.

15. The invention as defined in claim 14 further comprising:

r. said knobby surface speed being about one-fifth the gin speed, and s. said doffing surface speed being greater than said gin speed.

16. A process of feeding seed cotton to a roller gin having:

a. a gin roller with a peripheral surface, b. drive means connected to the gin roller for rotating the gin roller so the peripheral surface has a gin speed;

c. wherein the improved method comprises:

d. separating the locks of cotton into single seed locks, e. forming said single seed locks into a sheet of cotton with only a single layer of seed locks in said sheet of cotton, and f. feeding said sheet of single layered seed locks of cotton onto the gin roller.

17. The invention as defined in claim 16, further comprising:

g. the seed locks in said sheet of seed cotton having an average density of at least 100 seed locks per square foot.

* * * * *